US007946967B2

(12) United States Patent
Berhanu

(10) Patent No.: US 7,946,967 B2
(45) Date of Patent: May 24, 2011

(54) ARTICULATING EXERCISE HARNESS SYSTEM

(76) Inventor: Nahome Berhanu, Dumphries, VA (US)

( * ) Notice: Subject to any disclaimer, the term of this patent is extended or adjusted under 35 U.S.C. 154(b) by 102 days.

(21) Appl. No.: 12/314,172

(22) Filed: Dec. 5, 2008

(65) Prior Publication Data

US 2010/0144501 A1 Jun. 10, 2010

(51) Int. Cl.
*A63B 23/16* (2006.01)
*A63B 21/06* (2006.01)

(52) U.S. Cl. ..... 482/93; 482/50; 482/109

(58) Field of Classification Search ..... 482/44–50, 482/92–100, 105–109, 139–141, 143, 908, 482/910; 2/159, 161.1, 161.6; 473/450
See application file for complete search history.

(56) References Cited

U.S. PATENT DOCUMENTS

| | | | | |
|---|---|---|---|---|
| 3,820,783 | A * | 6/1974 | Caveness | 473/450 |
| 4,039,183 | A * | 8/1977 | Sakurada | 482/46 |
| 4,368,883 | A | 1/1983 | Tiktin | |
| 4,456,002 | A * | 6/1984 | Barber et al. | 602/22 |
| 4,487,412 | A | 12/1984 | Meeko | |
| 4,620,704 | A | 11/1986 | Shifferaw | |
| 4,684,122 | A | 8/1987 | Desmond et al. | |
| 4,725,057 | A | 2/1988 | Sifferaw | |
| 4,793,005 | A | 12/1988 | Hetzel, Jr. | |
| 4,943,052 | A * | 7/1990 | Powers | 482/108 |
| 4,949,957 | A | 8/1990 | Cucchiara | |
| 5,163,678 | A * | 11/1992 | Rogers | 473/59 |
| 5,271,617 | A * | 12/1993 | Gilford | 473/450 |
| 5,350,345 | A | 9/1994 | Frey | |
| 5,353,440 | A | 10/1994 | Meldeau | |
| 5,364,323 | A | 11/1994 | Liu | |
| 5,435,013 | A | 7/1995 | Davis | |
| 5,511,788 | A * | 4/1996 | Manley et al. | 473/213 |
| 5,582,402 | A * | 12/1996 | Gilford | 473/450 |
| 5,662,595 | A * | 9/1997 | Chesher et al. | 602/20 |
| 5,745,920 | A | 5/1998 | Olivier | |
| 5,746,685 | A | 5/1998 | Glaser | |
| 5,809,570 | A | 9/1998 | Grover | |
| 5,813,950 | A | 9/1998 | Parker | |
| 5,830,110 | A | 11/1998 | Fielding | |
| 5,846,168 | A | 12/1998 | Murray | |

(Continued)

FOREIGN PATENT DOCUMENTS

| | | |
|---|---|---|
| EP | 0 503 982 | 9/1992 |
| JP | H11-19270 | 1/1999 |

OTHER PUBLICATIONS

Gravity Boots; www.teeterhangups.com; 2 pages (Dec. 3, 2008).
Perfect Pushup; http://store.perfectpushup.com; 1 page (Nov. 7, 2008).

*Primary Examiner* — Tatyana Zalukaeva
*Assistant Examiner* — Daniel F Roland
(74) *Attorney, Agent, or Firm* — Pravel Intellectual Propery Law, P.C.; James W. Pravel

(57) ABSTRACT

An articulating exercise harness system includes a harness to secure a user's wrist and a handle that is selectively gripped by the user. A bracket is pivotally connected to the handle at a proximal end of the bracket. The harness is adjustably along the user's forearm relative to the position of bracket. A weight engagement member is rotatably connected to the bracket. The bracket is rotatable relative to the handle and the weight engagement member is rotatable relative to the bracket. Because the weight engagement member can rotate forward and backward on the bracket, relative to the handle, the invention can be used to both push and pull exercise weights or other loads.

5 Claims, 10 Drawing Sheets

U.S. PATENT DOCUMENTS 5,846,169 A * 12/1998 Tscheschlog ..... 482/105
5,938,547 A * 8/1999 Gilford ..... 473/450
5,967,947 A 10/1999 Glover
6,241,643 B1 * 6/2001 Loft et al. ..... 482/114
7,008,355 B2 3/2006 Emick
7,303,507 B1 * 12/2007 Jozsa ..... 482/50

* cited by examiner

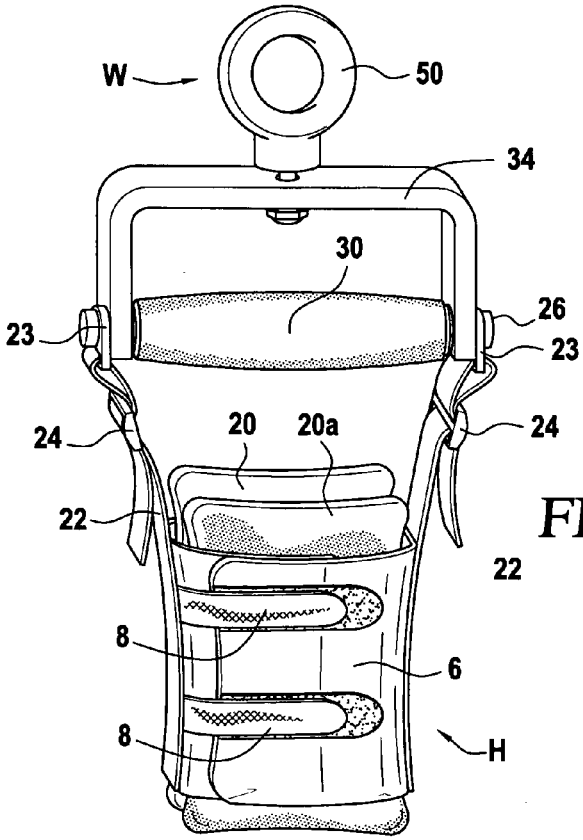
FIG. 3
FIG. 4A
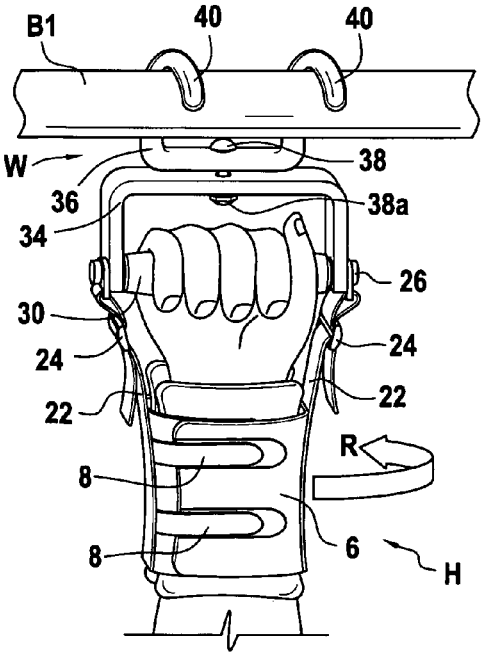
FIG. 4B
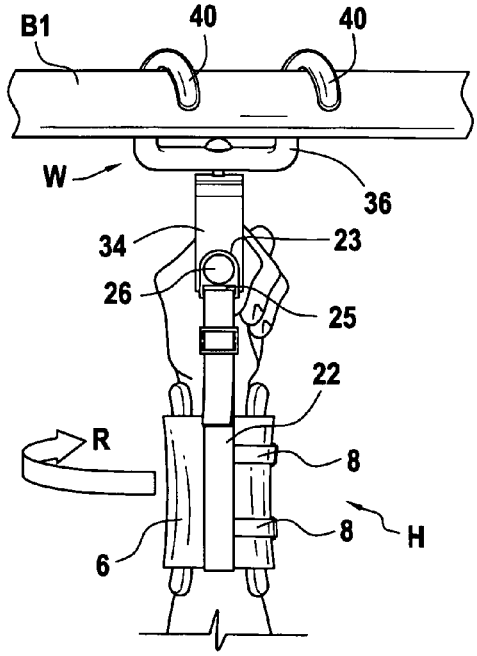

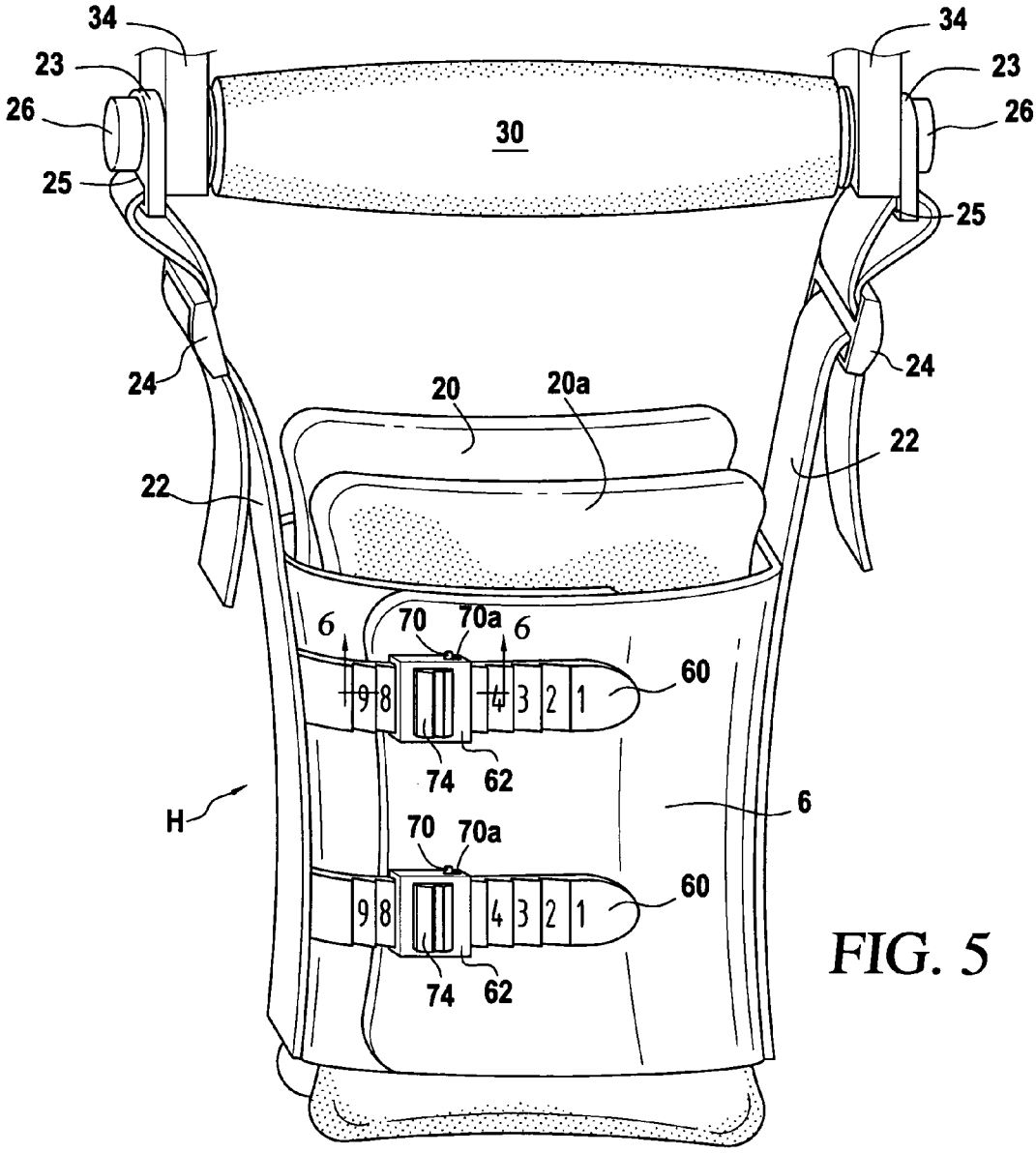
FIG. 5
FIG. 6
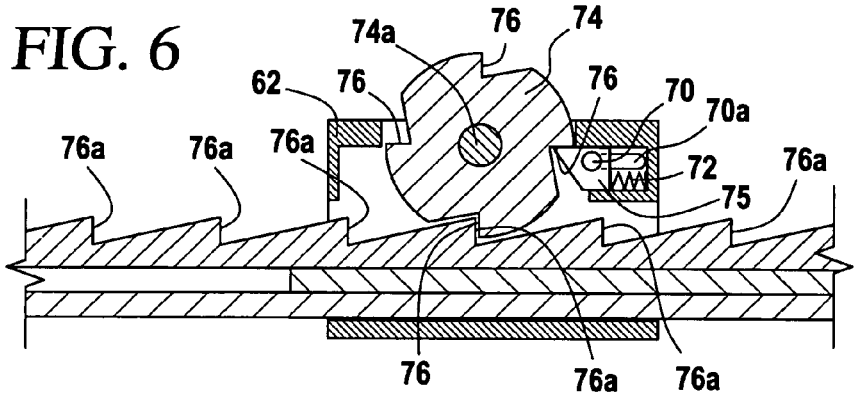

FIG. 7
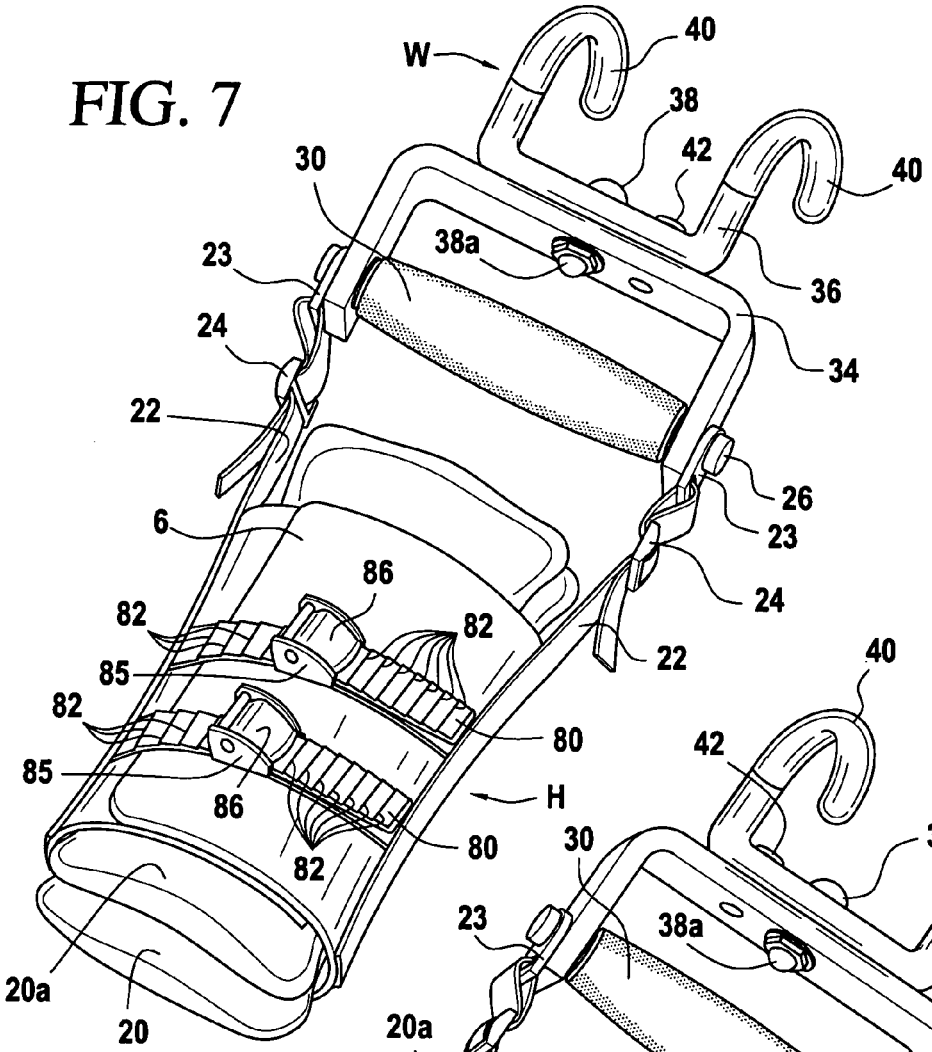
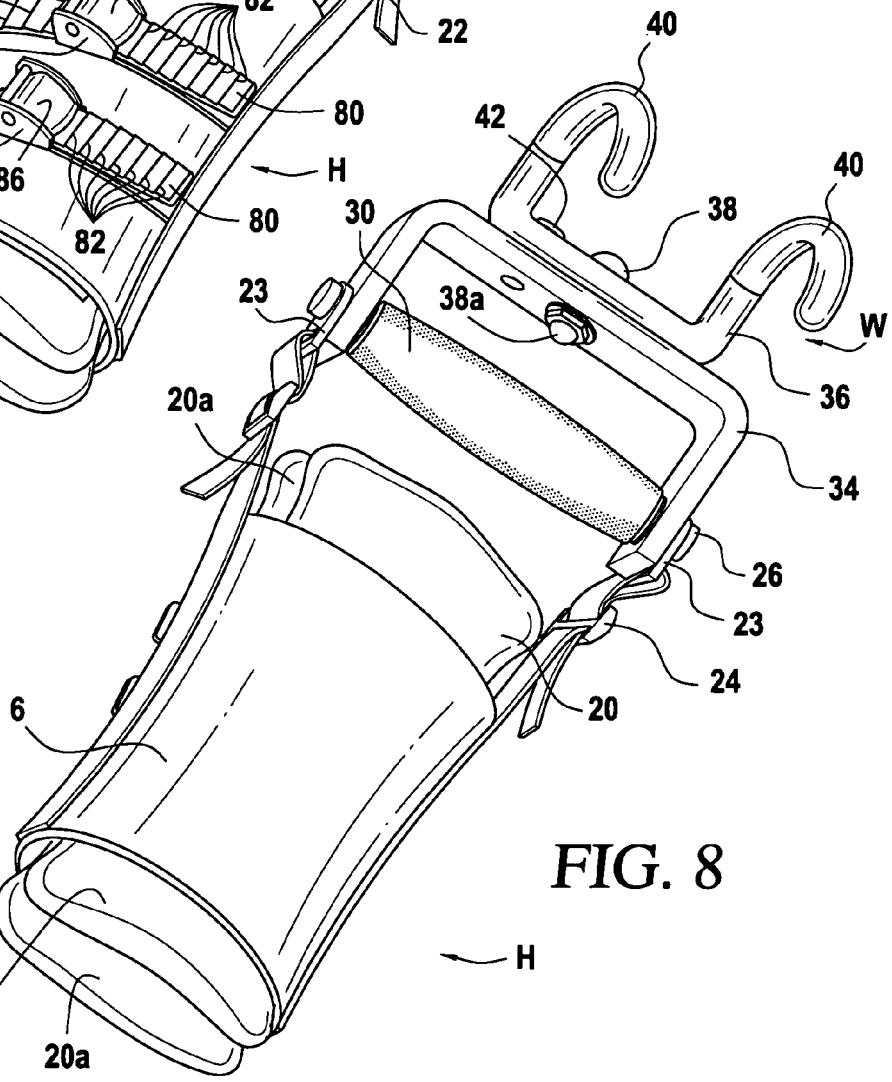
FIG. 8

ARTICULATING EXERCISE HARNESS SYSTEM

CROSS REFERENCE TO RELATED APPLICATIONS

Not applicable.

STATEMENT REGARDING FEDERALLY SPONSORED RESEARCH OR DEVELOPMENT

Not applicable.

REFERENCE TO MICROFICHE APPENDIX

Not applicable.

FIELD OF THE INVENTION

This invention relates to the field of exercise and manual load handling equipment.

BACKGROUND OF THE INVENTION

Effective weight training is achieved by isolating desired muscles through weight repetitions, and continuing weight repetitions to exhaustion. For maximum benefit, the repetitions are performed at a consistent aerobic tempo.

The isolation principle means to isolate only one targeted muscle group at a time, and consciously leave the other muscle groups out of the exercise. The difficulty is that other muscle groups that are included during an exercise or weight movement tend to contribute to the exercise and take the focus away from the targeted muscle. Non-targeted muscle groups can contribute more as the targeted muscle becomes fatigued, which is especially common at or near the end of a set of repetitive weight movements. If other muscles assist the targeted muscle, the impact of weight training is significantly reduced.

In particular, the forearms and wrists tend to assist with the weight movements that are used to train the muscles of the upper body. This is undesirable because it takes the focus off of the intended muscles. The focused upper body muscles primarily include the deltoids, biceps, triceps, pectorals and trapezius muscles.

Isolation of large muscles may also be important in working situations outside of the gym environment. For example, baggage handlers routinely lift numerous and sometimes, heavy luggage. Repeated lifting or movement of the luggage can cause the smaller muscles of the forearms to fatigue, which can limit the ability of the baggage handler to move large volumes of luggage during a work shift. Further, even if the baggage handler uses work gloves, his or her hands, wrists and fingers can become fatigued through repetitive use and gripping. It would therefore be advantageous for the baggage handlers to have a device that would allow them to isolate their large muscles and also allow them to grab onto luggage handles with a secure engagement means without having to grip onto luggage handles with their fingers.

It has also become a growing problem for workers to lift caskets. People worldwide, but especially in the United States are routinely overweight and the combined weight of a corpse and a coffin can exceed 650 pounds. It would be extremely helpful for those workers who lift and move caskets to have a device that would allow them to isolate their large muscles and also allow them to grab onto the rails or casket handles with a secure engagement means. Such a device could also be used when the caskets are moved about during and after manufacturing.

Similarly, it would be advantageous to have a device that could be used by anyone who lifts or moves heavy objects, such as at a loading dock or at a factory, to be able to isolate their large muscles and also allow them to grab onto handles on objects with a secure engagement means without having to grip onto handles or heavy objects with their fingers.

U.S. Pat. No. 4,949,957 ("the '957 patent") shows a weight-training cuff that fits snugly about the forearm and is used to attach directly to D-rings, which are then connected to weight training machines. The '957 patent does not provide any mechanism to directly engage weight bearing members, such as dumbbells, barbells, or to directly engage overhead bars or other bars or handles connected to loads.

US Patent Publication 2005/0085352 ("the '352 publication") shows a 360-degree rotator attachment for exercise equipment. The device of the '352 publication provides a rotational element to the traditional front/back (or flexion and extension) activities during the lifting of weights, but does not provide any isolation of target muscle groups.

What is needed is a device that would isolate the targeted muscles by securing the smaller muscles of the forearm to direct weight loads to specific upper and lower body muscles. The device should provide positive articulating engagement between the forearm and the bar on which the weights are mounted or between the forearm and a weight-bearing bar, such as a chin-up bar. The device should also allow controlled rotational movement of the forearm and wrist to direct the rotational movement to the targeted upper body muscles.

Such a device could also be used by dock or factory workers to move boxes or crates, or any weighted object and may also be used by other workers to move heavy loads.

SUMMARY OF THE INVENTION

The present invention provides a forearm harness device for muscle isolation during physical exercise and weight training. The device may be useable at the gym, with weight lifting equipment, and at home, from overhead bars, or the like. The device may also be used to lift or move weighted objects in a work environment, for example, baggage handling, casket moving, or heavy object moving, for example on a loading dock or factory.

An embodiment of the invention comprises a harness to secure a user's wrist and a handle that is selectively gripped by the user. The handle need not be gripped by the user, but may be gripped for pulling or for the natural gripping reflex when lifting. A bracket is normally pivotally connected to the handle at a proximal end of the bracket. Thus, the harness and the user's arm can rotate forward and backward relative to the handle. The harness may be adjustable along the user's forearm relative to the position of bracket. A weight engagement member is typically rotatably connected to the bracket. In an embodiment of the invention, the weight engagement member comprises a plurality of hooks that can engage a desired cylindrical object during physical exercise. The bracket is rotatable relative to the handgrip and the hooks are rotatable relative to the bracket. Because the hooks can rotate forward and backward on the bracket, relative to the handle, the invention may be used to both push and pull exercise weights or other loads.

The instant invention provides the unexpected result of isolating the desired upper body muscles, while providing multi-range, rotational motions to the upper range muscles through the direct, rotational connection between the device and the weight-bearing bar. The multi-range of motions results from the rotation between the hooks and the bracket, which is connected to the harness with adjustable straps.

The invention also provides unexpected results of control during exercise. Because the weight engagement member, or hooks of the invention directly engage the workout equipment, such as deadweights, machines or chin-up bars, or other loads, the motion is translated directly to the user through the bracket and forearm harness. The user feels much more control of the workout equipment than if he or she were engaging the equipment indirectly with cables or the like. The feeling of control during weight movement can contribute both to safety and to motivation. The control provided by the invention allows the user to push or pull weights through the articulation of the hook member, connected to the bracket, which is connected to the harness. The articulated connection between the bracket, handle, and weight engagement members limits side-to-side movement of the user's arms, which also adds to the feeling of control by the user when moving weights. The control also contributes to safety by minimizing uncontrolled side-to-side movement of the harness or the user's arms relative to the weight being moved.

The invention also eliminates the need for the user to grip bars, dumbbells or other machine or lifting handles, which reduces the fatigue of the user's fingers and wrists.

An additional significant benefit of the invention is that the hooks contact the exercise equipment or other weighted materials so that personal hygiene in a public gym or other public location is not compromised.

These and other objects, features, and advantages of the invention may be better understood from the detailed description that follows and the accompanying drawings.

BRIEF DESCRIPTION OF THE DRAWINGS

FIG. 3 shows an anterior view of the inventive articulating exercise harness system including a ring attachment adapter and hook and loop fastener straps on the harness.

FIG. 4A shows an anterior view of the inventive articulating exercise harness system with the hook members engaged with an overhead bar.

FIG. 4B shows a side view of the inventive articulating exercise harness system of FIG. 4.

FIG. 5 shows an anterior view of the inventive articulating exercise harness system with a detail of a pair of ratcheting buckle assemblies.

FIG. 6 shows a detail section view of a ratcheting buckle assembly taken from line 6-6 of FIG. 5.

FIG. 7 shows an anterior, isometric view of the inventive articulating exercise harness system with a detail of a pair of clamp buckle assemblies.

FIG. 8 shows a posterior, isometric view of the inventive articulating exercise harness system of FIG. 7.

DETAILED DESCRIPTION OF THE INVENTION

Figure 1:
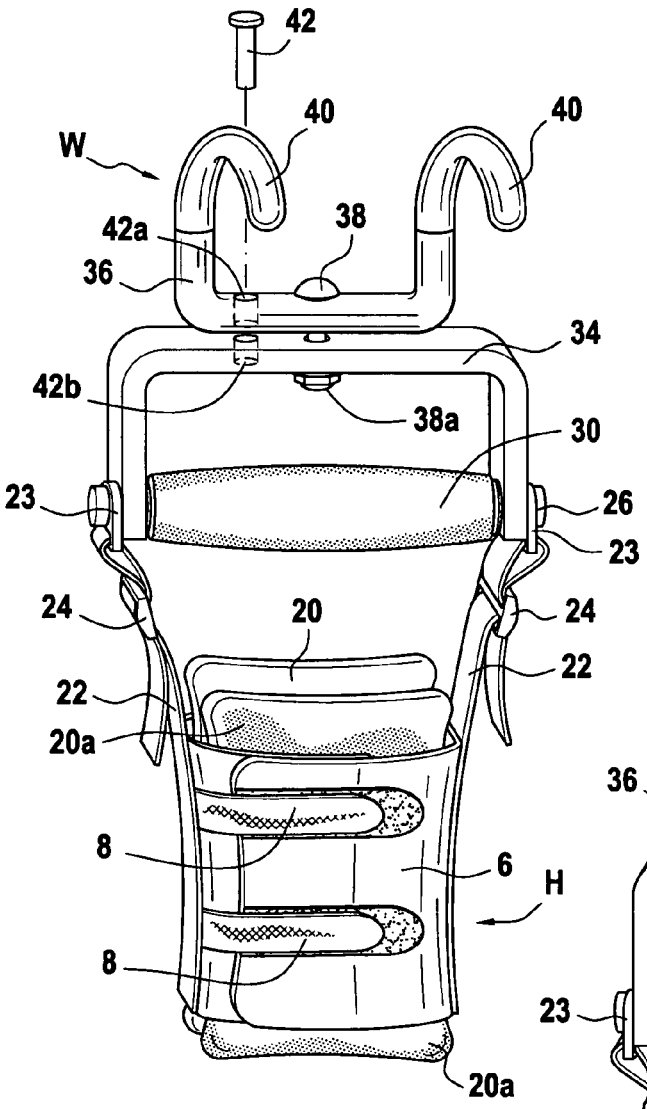
FIG. 1 shows an anterior view of an embodiment of the inventive articulating exercise harness system including hook and loop fastener straps on the harness.
Figure 2:
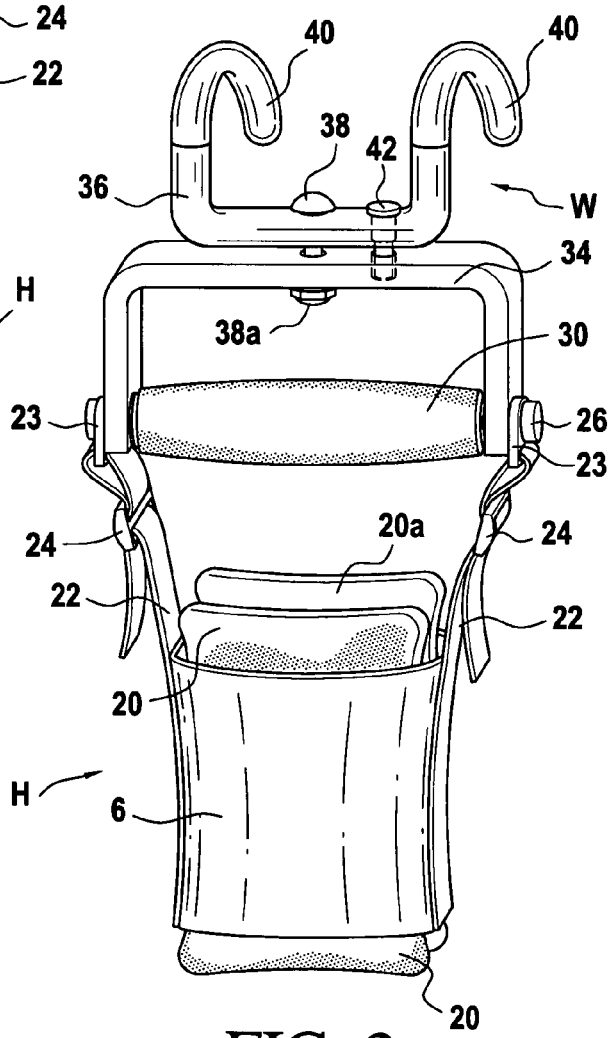
FIG. 2 shows a posterior view of the inventive articulating exercise harness system of FIG. 1.

An embodiment of the invention is shown is FIGS. 1 and 2 in which the harness H is formed from a shell 6, which is wrapped around a user's wrist (see FIG. 4A), and secured with straps 8. Straps 8 may be secured to the shell 6 with hook and loop material such as Velcro® or other desired engagement means. Pads 20,20*a* are positioned inside of the shell 6, with pad 20 positioned on the posterior side of the harness H and pad 20*a* positioned on the anterior side of the harness H. Pad 20,20*a* may each be of the same resilient polymer material or may be of different materials of different densities.

The shell may be constructed of flexible material, such as Hytrell®, flexible polymer, fiberglass, or mica, or may be constructed of a more rigid material.

The harness H is typically connected to a bracket 34 with adjustable straps 22, but the harness may also be connected with a fixed, non-adjustable connection. The bracket 34 is typically substantially c-shaped and includes a handle 30 mounted between the proximal ends. The bracket 34 may also be horseshoe shaped or other desired shape. The handle 30 is typically mounted to the bracket on a shaft 26. The shaft 26 may be constructed of nylon, alloy or carbon or stainless steel or other desired material. The handle 30 may also be constructed of a rigid or resilient polymer, wood or other metallic material. A threaded bolt with securing nuts on the ends or other mounting means may also be used to mount the handle 30 to the bracket 34 at the proximal end of the bracket 34. The bracket 34 is free to rotate forward and backward about the shaft 26. The length of straps 22 may be adjusted with a buckle 24 on each strap 22 so that the position of the handle 30 relative to the harness H can be changed to provide a custom fit for each user. Straps 22 are typically mounted to each end of the shaft 26 with a swivel 23, which has a slot 25, through which each strap passes (best seen in FIG. 5). The swivel 23 allows the straps 22 to swivel freely about the shaft 26 for smooth performance of the invention during exercises and use when the forearm and harness are rotating forward and backward relative to the handle 30 and shaft 26.

A weight engagement member W is rotatably attached to the bracket 34 with a fastener, such as a pin 38. The weight engagement member W may be a hook pair 36, as best seen in FIGS. 1 and 2 or it may be a ring 50, as shown in FIG. 3, or it may be any desired connection to engage a weight bearing load. The pin 38 is typically secured with a nut 38*a* or other securing means, such as a cotter pin, or the like. A securing pin 42 may be inserted into the pinhole 42*a*, in the hook member 36 and then into the pinhole 42*b*, in the bracket 34. The securing pin 42 can prevent the rotation of the hook member 36. A spring-loaded pin may also be used in place of the removable securing pin 42. The hook pair 36 typically includes a pair of hooks 40 that extend upward from the base of the hook member 36. The hooks 40 may include a polymeric coating or other textured coating to prevent the hooks 40 from slipping along the surface to which the hooks 40 engage. The radius of curvature or shape of the hooks 40 can be enlarged or changed to conform to the profile of the object to be engaged.

The weight engagement member W may also comprise a rotating ring member 50 (shown in FIG. 3). The ring member 50 may be used to engage a hook on a cable end, or to engage a weight bearing or static pin member (not shown).

In FIGS. 4A and 4B, an embodiment of the invention is shown that includes hook pair 36, comprising hooks 40. The hooks 40 engage the bar B1. Bar B1 may be an overhead bar or any bar that the user may want to push or pull. Bar B1 may, for example, be attached to luggage, or a trashcan, or a crate, or a casket, or any other weighted object. The bracket 34 is free to rotate about pin 38, which is rotatably connected to the hook pair 36 and is secured to the hook pair 36 by a nut 38*a* or a cotter pin, or the like. In FIG. 4A, the anterior side of harness H is shown parallel to bar B1. In FIG. 4B, the harness H is shown rotated such that the anterior and posterior sides of harness H are perpendicular to bar B1. The rotational arrow R indicates the rotation of the harness H and bracket 34 relative to the bar B1. Rotation R of the harness H and bracket 34 allows the user to isolate exercises or the movement of weight to desired muscle groups, or simply to change the desired workout, by rotating the harness H and bracket 34. The rotation R also allows the user to direct force toward the load being moved in the most convenient possible angle. Such a situation may become desirable, for example, when moving crates on a crowded loading dock. Other situations can be imagined where it would be desirable to direct force to the load being directed with the inventive device.

In FIGS. 4A and 4B, the user's palm is shown with the fingers gripping the handle 30. Because the securing straps 8 of the harness H, secure the user's forearm within the harness H, it is not necessary for the user to grip the handle 30. Instead, the user could also hang from the hooks 40 with his or her fingers open and not gripped around the handle 30.

Referring to FIGS. 5 and 6, a detail of a pair of ratcheting buckle assemblies is shown on the anterior side of the harness H. Each ratcheting buckle assembly includes a strap 60, which has a plurality of ridges 76*a* (best seen in FIG. 6). Gear 74, shown in cross section in FIG. 6 is positioned inside of the buckle body 62. Gear 74 includes notches 76 about its circumference. Gear 74 rotates on a shaft 74*a*. Strap 60 passes through buckle body 62. The ridges 76*a* on the outer surface of the strap 60 engage the notches 76 on the gear 74. Numbered indicia are typically positioned on the outer surface of each strap 60, as shown in FIG. 5. The numbered indicia provide a reference so that each strap 60 can be pulled to the same position within the corresponding buckle body 62 and so that individual settings can be recalled when the harness H is secured to a user's forearm. As the strap 60 is pulled through the buckle body 62, the ridges 76*a* on the strap 60, contact the notches 76 and cause the gear 74 to rotate about the shaft 74*a*. A retaining dog 75 engages the each notch 76 of the gear 74 as the gear 74 rotates. The retaining dog 75 is urged forward toward the outer surface of gear 74 with spring 72. The user can retract the retaining dog 75 by sliding the release pin 70 away from the outer surface of the gear 74. The release pin 70 slides in slot 70*a*. When the release pin 70 is slid away from the outer surface of the gear 74, the retaining dog 75 no longer engages the notch 76 of the gear 74 and the gear 74 becomes free to rotate. Once the gear 74 is free to rotate, the strap 60 can be released from the buckle assembly.

One or a plurality of buckle assemblies as desired may be included to secure the harness H, depending upon the amount of compression desired.

An alternative buckle assembly is shown in FIGS. 7 and 8. The anterior side of the harness H is shown in FIG. 7 and the posterior side of the harness is shown in FIG. 8. The buckle assembly includes a strap 80 and a buckle 86. Strap 80 includes a series of ridges 82, which are engaged by the buckle latch 86 when the buckle latch is in the closed position. The buckle latch is contained within the buckle body 85.

Description of Exemplary Exercises Performed with the Invention

The invention may be used for exercise workouts that include, but are not limited, to the following:

Shoulders: bar upright row, dumbbell lateral raise, shrugs, standing scarecrow, military press, pull downs and straight-arm pull-up.

Back: pull-ups, pull downs (lateral), cable seated low row, barbell bent-over row, dead lift, seated reverse fly, one arm row and Australian pull-ups.

Legs: dumbbell lunge, dumbbell squats (beginner squats), dumbbell Bulgarian squats, Sumo squats and Romanian deadlift.

Arms: dumbbell biceps curls, barbell biceps curls, cable triceps pulldowns, preacher biceps curls, cable triceps extensions, overhead bar press, cable biceps curls, triceps kick-back, upright row, angled prone curls, Swiss-ball preacher curls, French press and standing concentration curls.

Abdominals: standing oblique crunches, kneeling cable crunches, weighted side bends, pull-up bar leg-ups, abdominal reverse curls and high woodchopper.

Chest: cable crossover, cable chest fly, dumbbell pullover, parallel bar dip, dumbbell fly, single arm external rotation, unilateral high cable fly and unilateral low cable fly.

Figure 9:
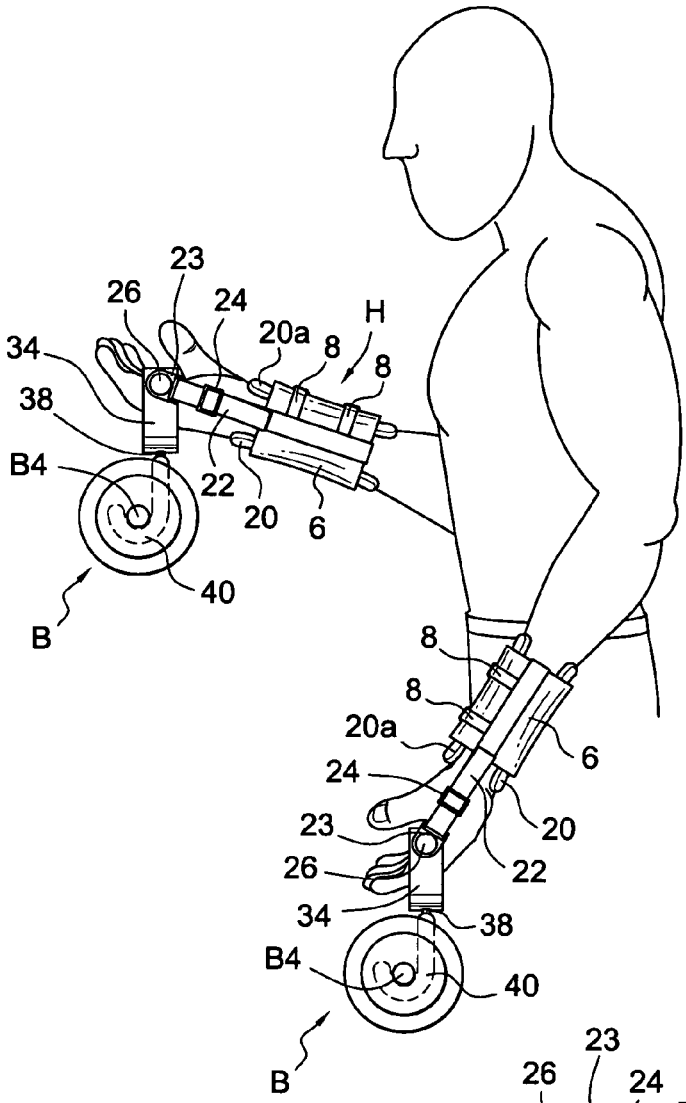
FIG. 9 shows a side view of a pair of the inventive articulating exercise harness systems in use with the hook members engaged with a pair dumbbells and showing the user's palms in the open position.

In FIG. 9, an embodiment of the invention is shown while performing bicep curls. The harness H is secured to the user's forearm with straps 8. Straps 8 are secured to the harness H with hook and loop fastener material, or with a buckle assembly (as shown in FIGS. 5-7), or with a desired fastener to secure the harness H to the forearm. Straps 22 may be adjusted with the buckle 24 to position the handle 30, which is mounted on the shaft 26, to the desired position at approximately the position of the user's palm. The user's fingers are shown in an open position in FIG. 9, but they may also be closed around the handle 30 (handle 30 is best seen in FIG. 1).

Figure 10:
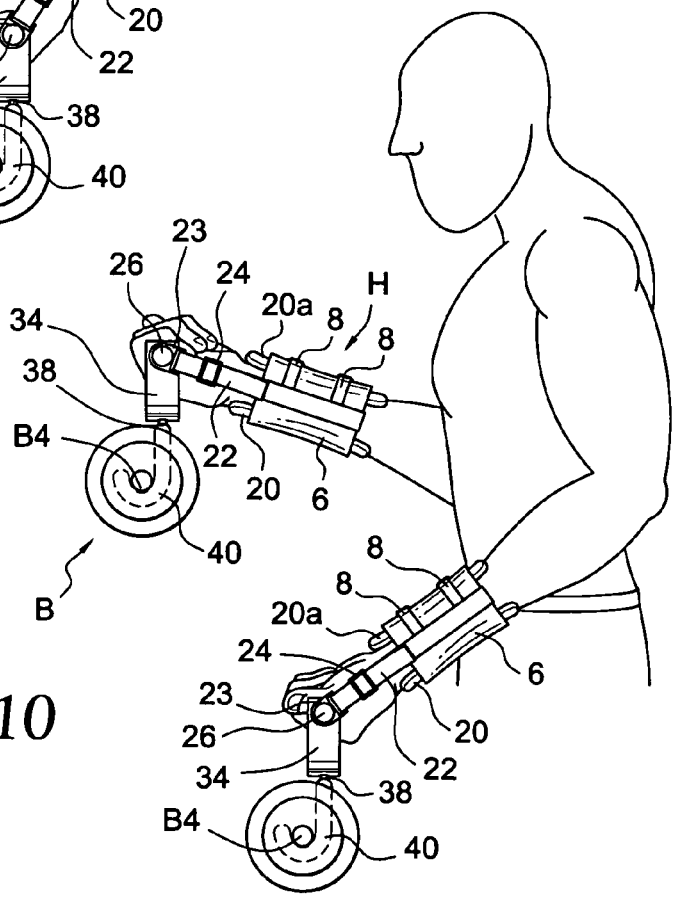
FIG. 10 shows a side view of a pair of the inventive articulating exercise harness system in use with the hook members engaged with a pair of dumbbells and showing the user's palms gripped around the handles.

Still referring to FIGS. 9-10, the hook 40 is shown engaged with the bar B4 of a dumbbell. As the user lifts and lowers the dumbbells, bracket 34 rotates about shaft 26. The hooks 40, which comprise the hook pair 36, are connected to the bracket 34 and rotate together with the rotation of the bracket, about shaft 26. Although not shown in FIG. 9, the user's forearms and wrists can be rotated about pin 38 to allow the hooks 40, and the dumbbells to rotate. Such a rotation provides varied motion to allow the user to isolate desired muscles while performing the dumbbell lifts.

FIG. 10 illustrates the use of an embodiment of the invention to perform bicep curls with a dumbbell, but in FIG. 10 the user is optionally gripping the handle 30.

Figure 11:
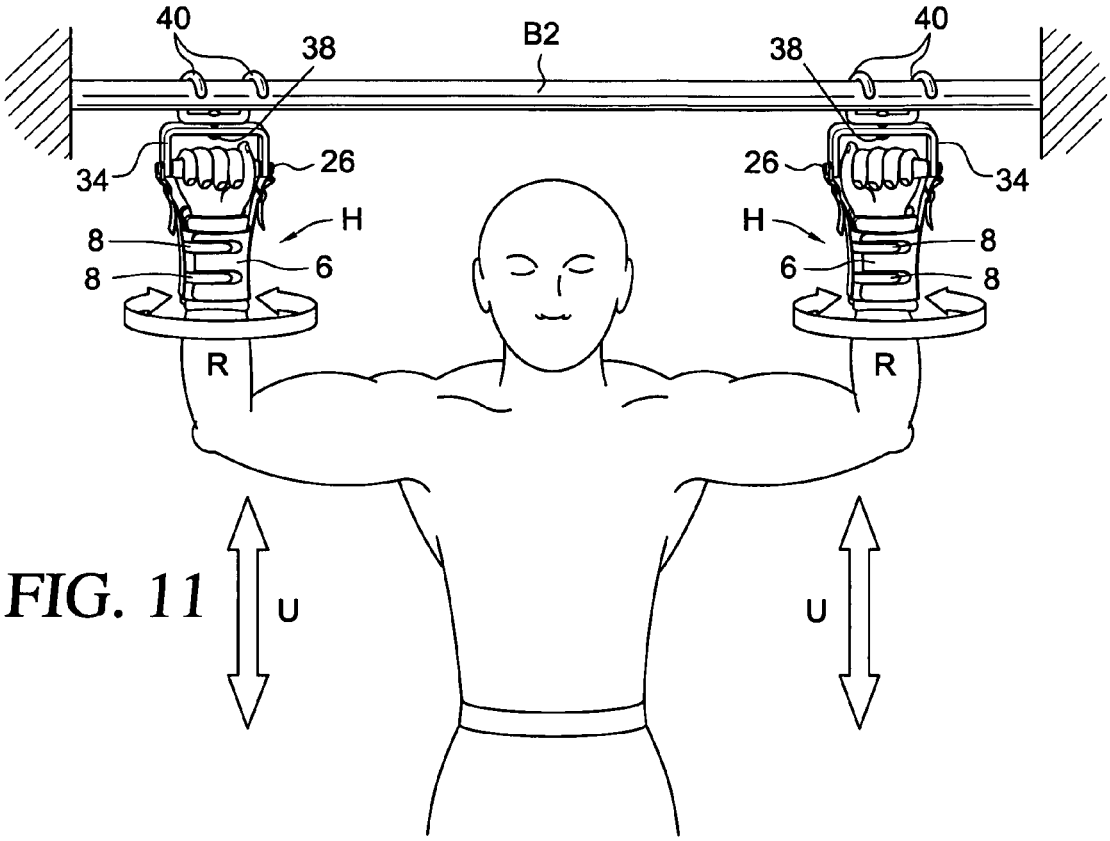
FIG. 11 shows an anterior view of the inventive articulating exercise harness system in use with the hook members engaged with an overhead bar and showing rotation of the harness and the user's arms.

FIG. 11 illustrates the use of an embodiment of the invention with an overhead bar B2. The user has connected the hooks 40 to the bar B2. The hooks 40 may be coated with a textured material to prevent them from sliding along the bar B2. The user's arms are secured in the harnesses H. The user is able to rotate his forearms in the direction shown by arrow R. Such rotation allows the user to isolate the tension imposed on his body to specific muscles while moving his body upward or downward (indicated by the letter U). The straps 8 may be secured tightly enough to allow the user to relax his grip on the handle 30 (shown in FIG. 1), which is mounted on shaft 26. If desired, the user is also able to swing forward and backward as the harness H rotates about shaft 26.

Figure 12:
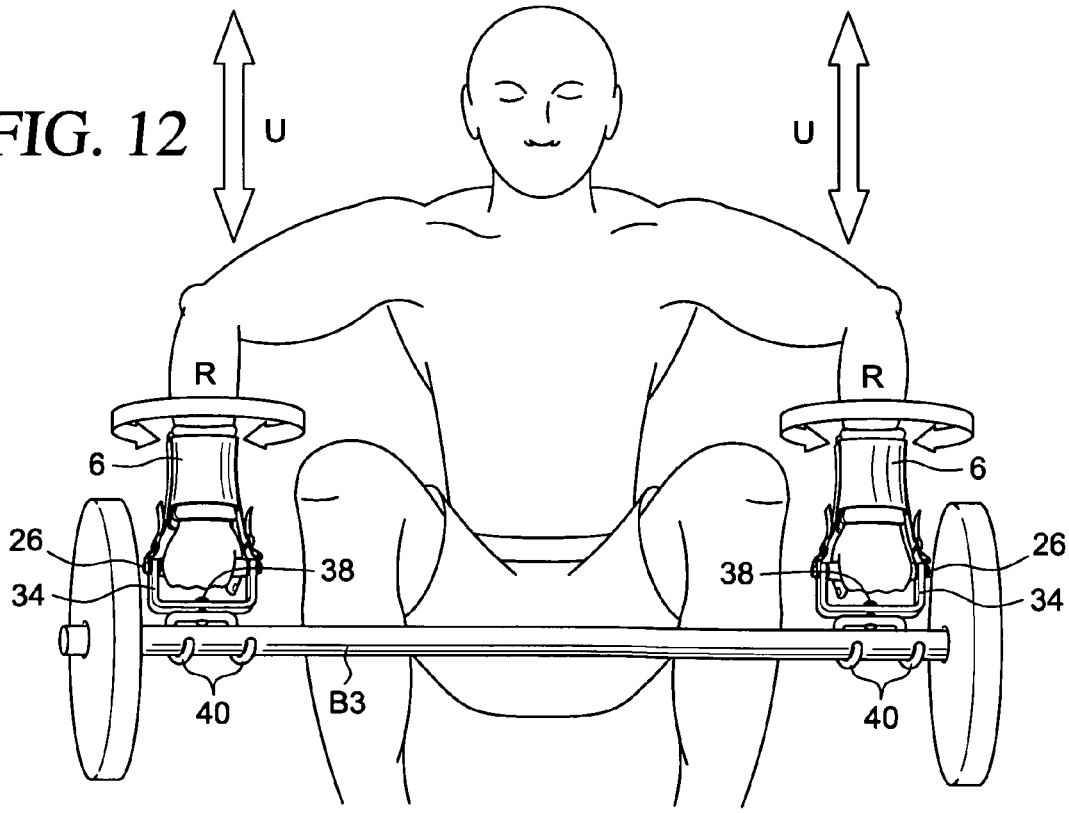
FIG. 12 shows a posterior view of the inventive articulating exercise harness system in use with the hook members engaged with a barbell and showing rotation of the harness and the user's arms.

FIG. 12 illustrates the use of an embodiment of the invention to raise and lower a barbell B3. It also shows how the user can rotate R his forearms to isolate the exercise and weight during repetitions of the movement upward and downward U.

Figure 13:
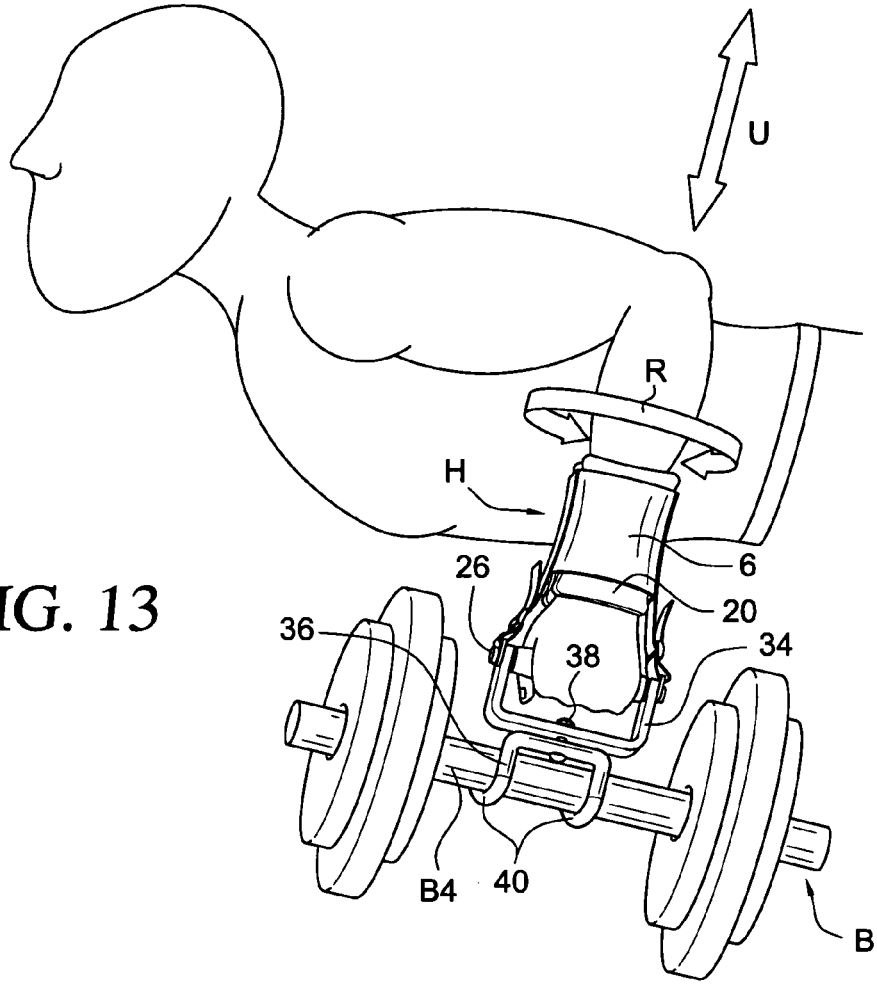
FIG. 13 shows a posterior view of the inventive articulating exercise harness system in use with the hook members engaged with a dumbbell and showing rotation of the harness and the user's arms.

FIG. 13 illustrates the use of an embodiment of the invention to perform dumbbell rows with a dumbbell B. It also shows how the user can rotate R his forearms to isolate the exercise and weight during repetitions of the movement upward and downward U.

Figure 14:
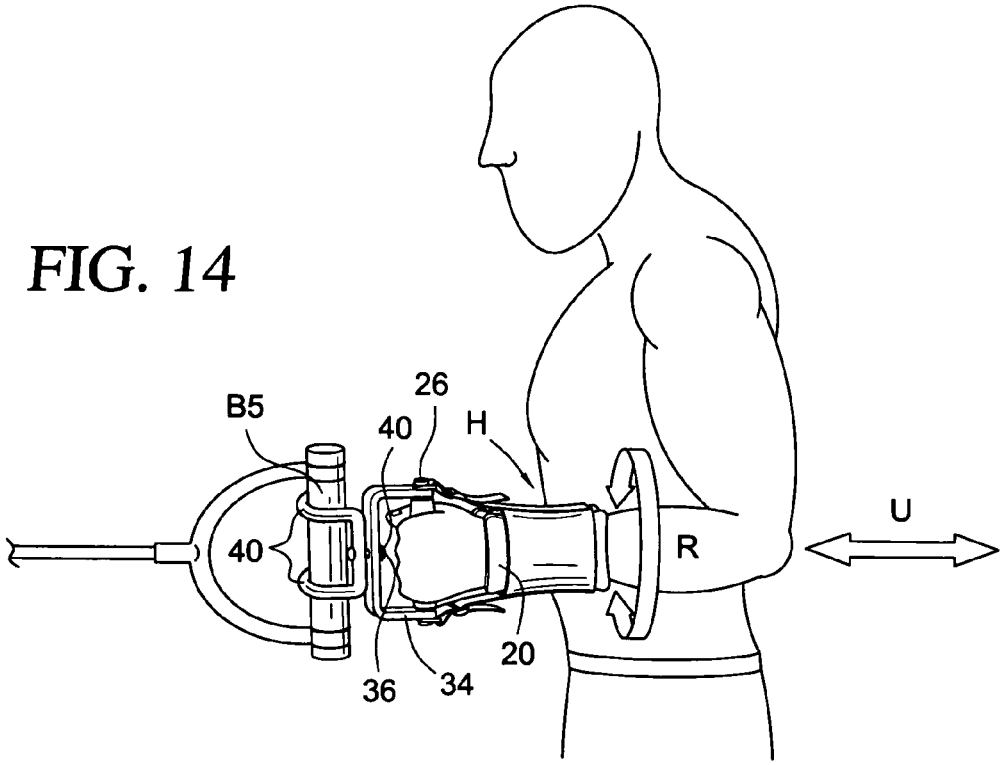
FIG. 14 shows the inventive articulating exercise harness system in use with the hook members engaged with a handle on a weight engaging cable and showing rotation of the harness and the user's arms.

FIG. 14 illustrates the use of an embodiment of the invention to pull on the handle B5 of a cable, such as on a cable row exercise machine. It also shows how the user can rotate R his forearms to isolate the exercise and weight during repetitions of the movement forward and backward U.

Figure 15:
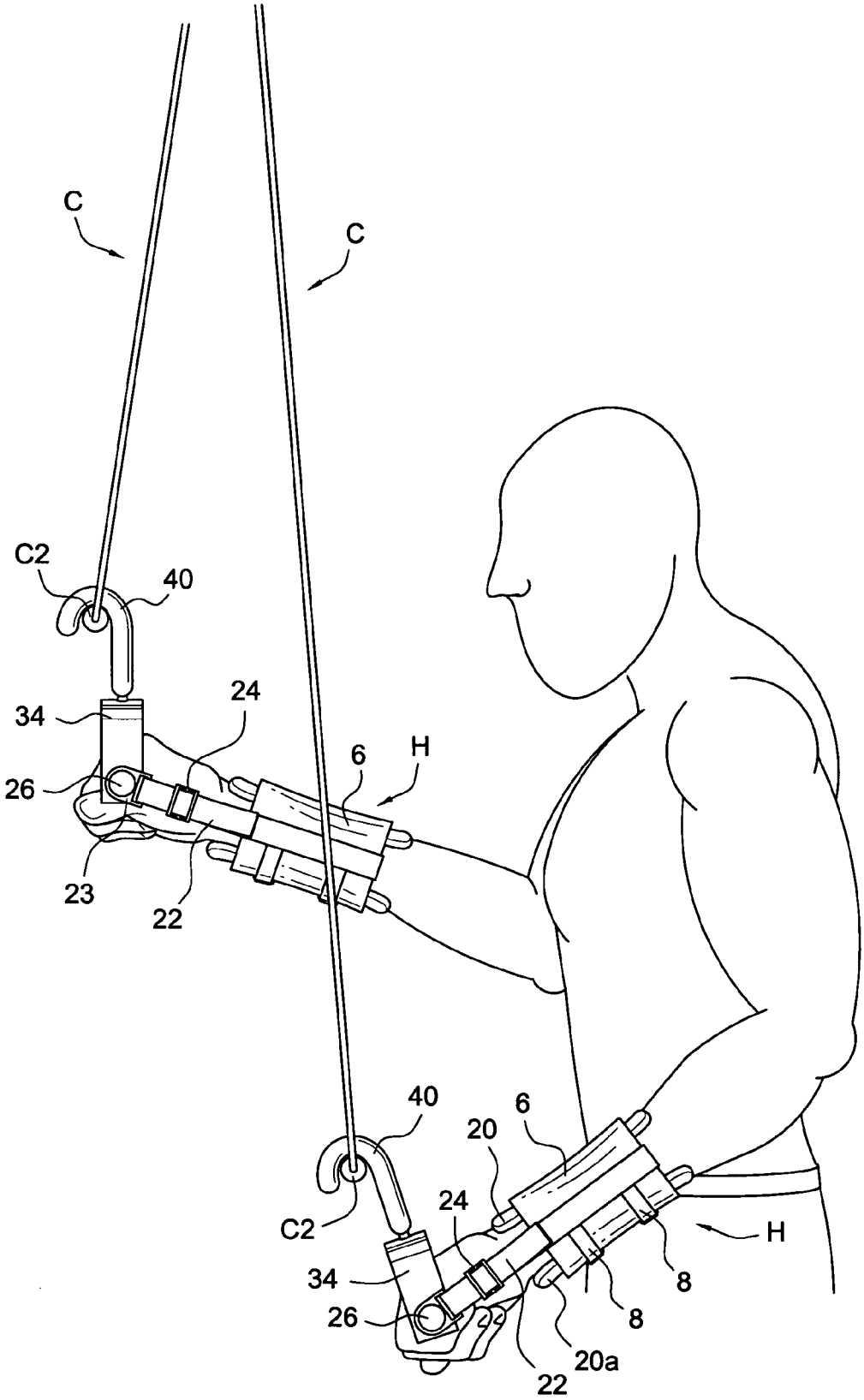
FIG. 15 shows a side view of the inventive articulating exercise harness system used to exercise with handles on a cable pull machine showing rotation of the hooks and brackets relative to the cable pull handles and the user's arms.

FIG. 15 illustrates the use of an embodiment of the invention to pull down on a pair of cables, for development of the back muscles. It also shows how the hooks 40 and brackets 34 rotate as the cable handles C2 move up and down. The user could also push the cables down without gripping the handle 30, by just using his forearms to push the harness H, which is connected to the shaft 26, the bracket 34 and the hooks 40.

Figure 16:
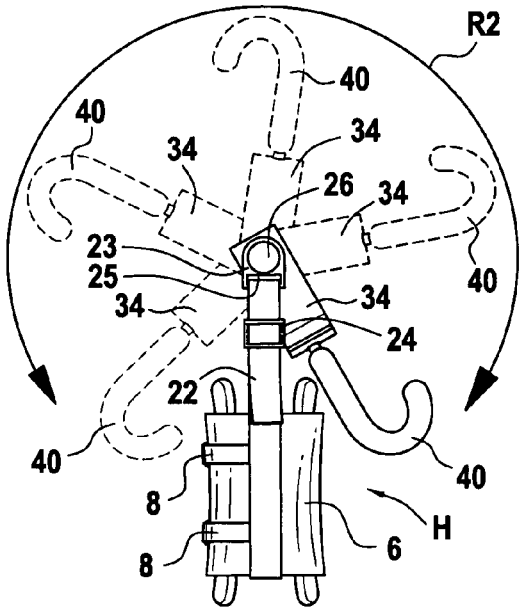
FIG. 16 shows a side view of the inventive articulating exercise harness system and the range of motion of the hooks and bracket about the handle and shaft.
Figure 17:
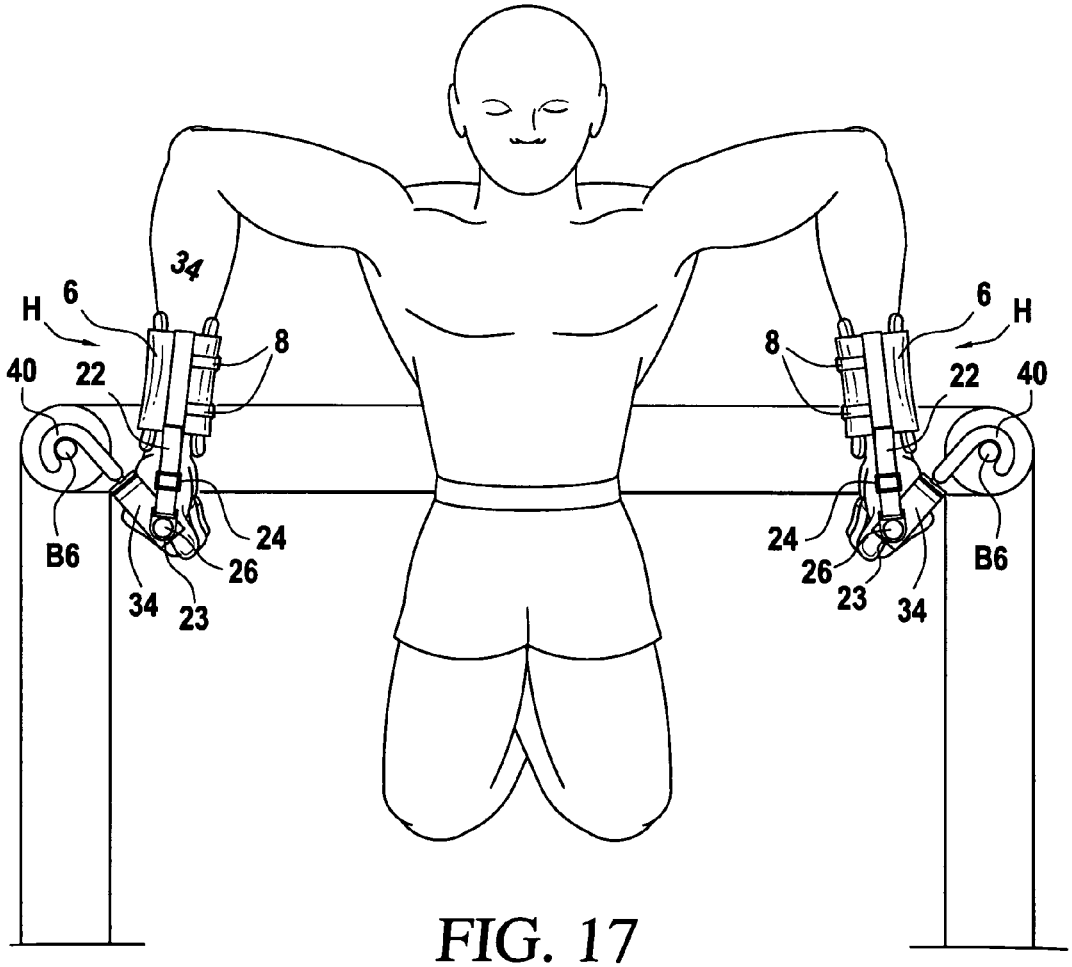
FIG. 17 shows a side view of the inventive articulating exercise harness system used to exercise by pushing up and down with handles on a parallel dip bars.

FIG. 16 illustrates the rotation R2 of the hooks 40 and the X bracket 34 about the shaft 26. The rotation R2 of the hooks and bracket 34 about the shaft 26 allows the invention to be used to push bars and objects. For example, in FIG. 17 the user is performing dips on two parallel bars B6 by pushing his weight upward. The hooks 40 are engaged with parallel bars B6, while bracket 34 is free to rotate outward toward the parallel bars B6 and away from the user.

Figure 18:
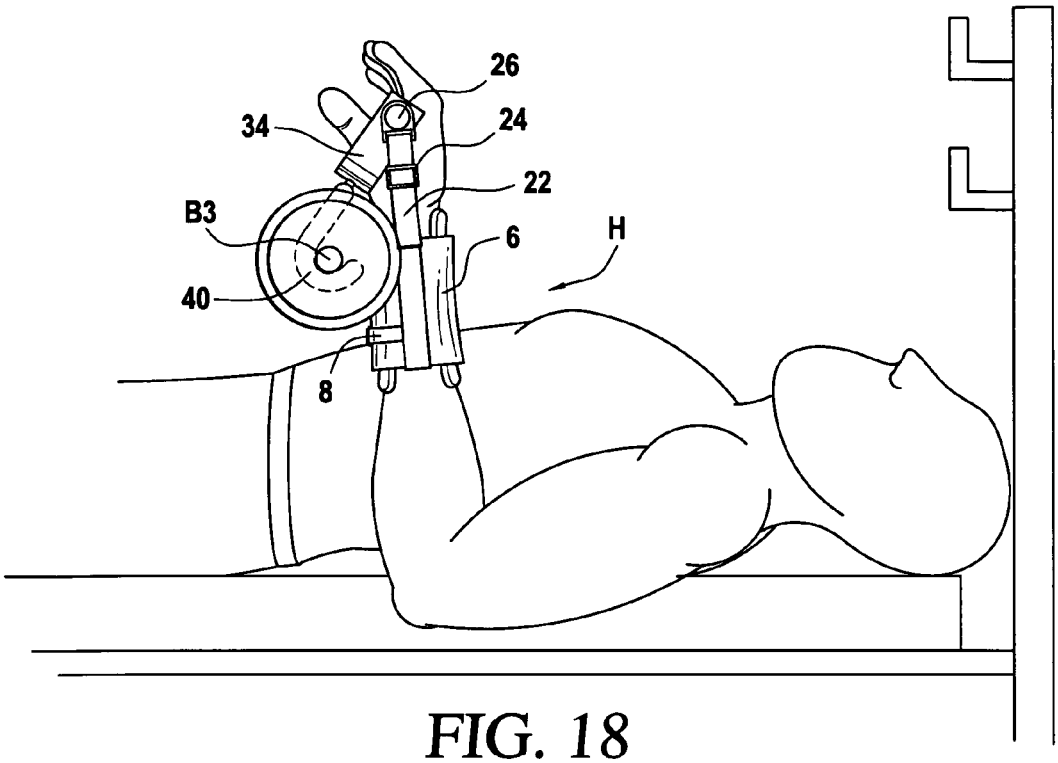
FIG. 18 shows a side view of the inventive articulating exercise harness system used to lift a barbell on a bench press with the hooks and barbell rotated to the outside of the user's arms.
Figure 19:
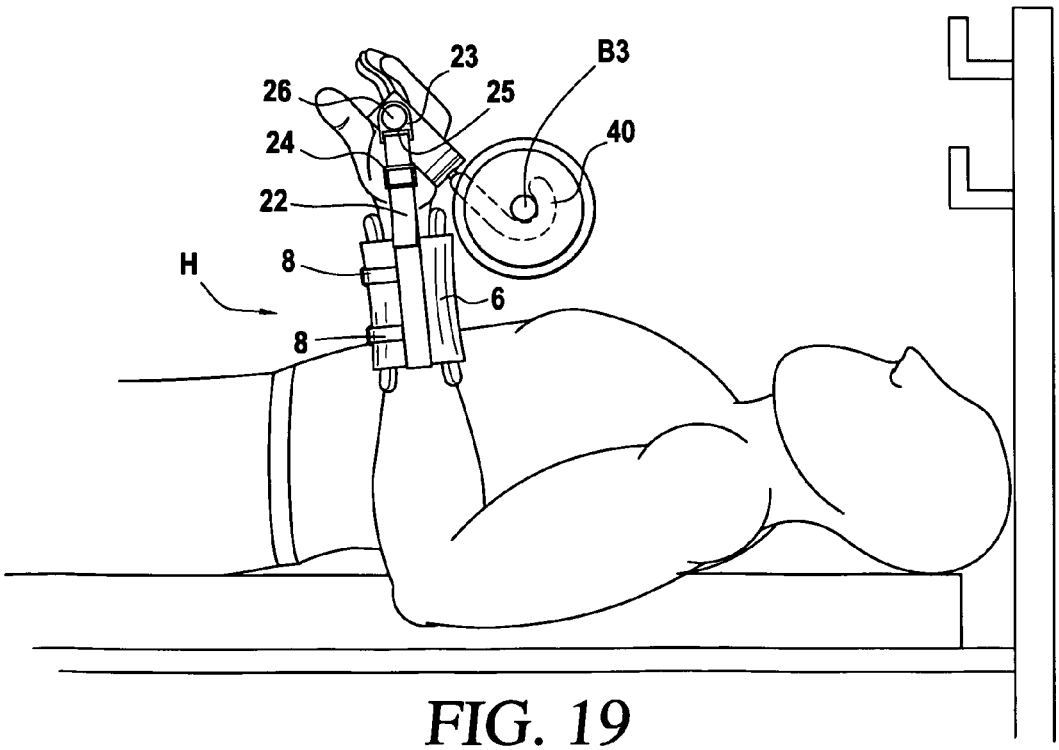
FIG. 19 shows a side view of the inventive articulating exercise harness system used to lift a barbell on a bench press with the hooks and barbell rotated to the inside of the user's arms.

FIGS. 18 and 19 show the use of an embodiment of the invention on a bench press. FIG. 18 illustrates the way in which the bracket 34 and hook 40 can rotate to the anterior side of the user's forearm and harness H, while FIG. 19 illustrates the way in which the bracket 34 and hook 40 can rotate to the posterior side of the user's forearms and the harness H.

The invention may also be used outside of the gym environment for activities that include, but are by no means limited to the following:

baggage handlers at airports;

warehouse or loading dock workers to lift boxes or crates;

travelers to pull luggage during travel at airports;

workers to lift and carry caskets at a burial or funeral chapel;

sanitation workers to pull or lift trash cans; and household movers to move or lift furniture.

The invention is not limited to the above-described embodiments and other embodiments may fall within the scope of the invention, the claims of which follow.

What is claimed is:

1. An articulating forearm harness device for muscle isolation during physical exercise and weight movement comprising:

a. a harness to secure to a user's wrist;

b. said harness comprises a shell that wraps at least a portion of a user's forearm, said shell including at least one strap to secure the shell to the user's forearm, wherein a resilient material is inside of said shell to provide cushioning for the user's forearm, wherein the density of said resilient material on an anterior side of said shell is different from the density of said resilient material on a posterior side of said shell;

c. a handle to be selectively gripped by the user;

d. a bracket pivotally connected to said handle at a proximal end of said bracket;

e. said harness being connected to said bracket;

f. a weight engagement member connected to a distal end of said bracket wherein said weight engagement member can engage a desired object during physical exercise; and g. said bracket being rotatable forward and backward relative to said handle.

2. An articulating forearm harness device for muscle isolation during physical exercise and weight movement comprising:

a. a harness to secure to a user's wrist;

b. a handle to be selectively gripped by the user;

c. a bracket pivotally connected to said handle at a proximal end of said bracket; wherein said bracket is substantially c-shaped, having a pair of proximal ends and a distal straight end, and wherein said handle is connected to said bracket between said proximal ends with a shaft; wherein said shaft extends outside of each pair of proximal ends of said bracket and said harness is connected to each end of said shaft with at least one adjustable strap; wherein each of said at least one adjustable strap is connected to each end of said shaft with a swivel member; and d. a weight engagement member connected to a distal end of said bracket wherein said weight engagement member is rotatable about a fastener relative to said bracket and whereby said weight engagement member can engage a desired object during physical exercise.

3. An articulating forearm harness device according to claim 1, wherein said strap includes a ratcheting buckle to secure said strap.

4. An articulating forearm harness device according to claim 1, wherein said strap includes a latching buckle to secure said strap.

5. An articulating forearm harness device according to claim 1, wherein said weight engagement member comprises a ring for engaging a hook.

* * * * *